United States Patent [19]

McNeil

[11] Patent Number: 4,884,372

[45] Date of Patent: Dec. 5, 1989

[54] CENTRIFUGAL FINISHING APPARATUS EMBODYING IMPROVED SEAL AND METHOD

[75] Inventor: Gary L. McNeil, Allegan, Mich.

[73] Assignee: Roto-Finish Company, Inc., Kalamazoo, Mich.

[21] Appl. No.: 105,273

[22] Filed: Oct. 6, 1987

[51] Int. Cl.[4] ..... B24B 8/00

[52] U.S. Cl. ..... 51/163.2; 51/163.1; 51/164.1

[58] Field of Search ..... 51/163.1, 163.2, 164.1, 51/422, 423, 7, 17

[56] References Cited

U.S. PATENT DOCUMENTS

| | | | |
|---|---|---|---|
| Re. 29,964 | 4/1979 | Balz | 51/163.2 |
| 3,924,357 | 12/1975 | Schmidt | 51/423 |
| 4,177,608 | 12/1979 | Balz | 51/163.2 |

FOREIGN PATENT DOCUMENTS

| | | | |
|---|---|---|---|
| 4636157 | 9/1968 | Japan | 51/163.2 |
| 452481 | 12/1974 | U.S.S.R. . | |
| 0580099 | 11/1977 | U.S.S.R. | 51/163.2 |
| 0942960 | 7/1982 | U.S.S.R. | 51/163.2 |

*Primary Examiner*—Frederick R. Schmidt
*Assistant Examiner*—Blynn Shideler
*Attorney, Agent, or Firm*—Gordon W. Hueschen

[57] ABSTRACT

Apparatus for finishing parts or workpieces in the presence of liquid in a finishing chamber having outer upstanding wall and bottom members which are symmetrically arranged about a common axis and relatively rotatable about the axis, for imparting motion to the contents of the chamber for finishing of the parts or workpieces therein, and means for causing the relative motion, having an improved resilient seal between the bottom and the wall members in the form of a resiliently-restricted zone, comprising a partial bottom-forming lip or other partial bottom-forming element, and means for pumping fluid into said zone at a sufficient pressure so that the fluid enters the zone and thence flows upwardly into the finishing chamber, is disclosed. Storage chambers below the bottom and adjacent the upstanding wall are employed for storage of fluid to be introduced into the finishing chamber. Separate drainage means for internal drainage of fluid from the finishing chamber is provided so that no drainage of fluid and "fines" goes through the seal. In a preferred embodiment a rotatable shaft associated with a rotatable bottom is hollow and passageways are provided from interior of the finishing chamber cavity into the hollow passageway for drainage of fluid out of the apparatus. A greatly improved seal having an extended life and permitting closer tolerances, as well as closer control and more efficient maintenance of tolerances, is thereby provided. An improved method for finishing parts involving purging of the seal comprising the resiliently-restricted zone with fluid under pressure from the various aforementioned sources outside the finishing zone proper as above-described is also disclosed.

17 Claims, 2 Drawing Sheets

10
13
12
53
53
56
58
22
14
45
50
38
24
74
40
39
84
76
16
18
46
54
47
43
20
36
62
60
30
34
32
64
66

CENTRIFUGAL FINISHING APPARATUS EMBODYING IMPROVED SEAL AND METHOD

BACKGROUND OF THE INVENTION

1. Field of Invention

Centrifugal surface finishing apparatus; improved sealing means between a relatively-rotating bottom and an outer upstanding wall of the finishing chamber thereof; method and means for providing and maintaining such seal employing a hydrostatic head or pressure of liquid, e.g., water or finishing compound solution, in a manner which prevents fouling of said seal by "fines" produced by attrition of finishing material and/or workpieces during the finishing process.

2. Prior Art

Apparatus and methods for the surface finishing of parts or workpieces by attrition with finishing material or media comprising relatively large finishing particles, also known as finishing chips, in a finishing chamber in the presence of a liquid vehicle, is well-established in the prior art. One type of finishing is known as centrifugal finishing and involves the employment of an apparatus having a containing surface comprising a bottom and an upstanding wall which are symmetrically arranged about a common axis and which are relatively rotatable about said axis in order to impart motion to the contents of the finishing chamber. In such apparatus, the bottom of the finishing chamber generally rotates relative to an outer upstanding wall, which is usually stationary, and through centrifugal action causes the contents to move radially outward toward and to impinge upon such upstanding wall.

Representative apparatus and method and seals for the juncture of the finishing chamber bottom member and the outer upstanding wall member are to be found in U.S. Pat. Nos. 4,177,608; 3,435,565; 3,990,188; and 4,026,075, as well as in German Offenlegungsschrift 2,705,445. In the apparatus of these patents, a seal is usually provided which prevents outflow of liquid vehicle or "compound" from the finishing chamber and such seals generally involve a rubbing contact between flat or irregular surfaces of the seal and the bottom, of the seal and the upstanding wall, or of the seal itself. Such seals are essential whether the type of apparatus is solely centrifugal in nature or whether resilient mounting means, such as springs or elastomer, are employed at some point beneath the finishing chamber and/or a vibratory action is imposed upon the centrifugal action, or employed as a part of the finishing process such as in an emptying phase. The presence of such a seal is required in all known centrifugal embodiments due to the relative motion between the finishing chamber bottom and the outer upstanding wall thereof.

All such arrangements to date have been costly, inefficient, have required excessive power for overcoming the considerable friction between the relatively-moving surfaces, and conducive to excessive wear, necessitating frequent replacement of the sealing means, and have moreover not been effective in eliminating the fouling of the seal between the relatively-rotating bottom of the finishing chamber and the outer upstanding wall thereof by the "fines" produced during the finishing process by attrition of the finishing material and/or the parts or workpieces being finished. This is true even though lubrication of the seal has sometimes been effected by the employment of a pump and associated equipment to force lubricating fluid into the seal. Due to deficiencies in the structure of the apparatus and of the seals previously available and in the method employed for finishing, including effecting and maintaining such seal, and especially for drainage of fluid from the finishing chamber which, at least partially, has generally involved return or drainage of fluid and entrained fines through the seal or to the same source from which the liquid vehicle was originally pumped, previous equipment and procedure leaves much to be desired. Thus, all prior art approaches to date, whether of the "closed system" or of the "flow through" type, and all known variations thereof, have imposed serious limitations upon the employment of such centrifugal apparatus and method. The present invention provides a superior and highly advantageous structure and seal and fulfils a long-felt need for the same, while concurrently avoiding the shortcomings of the prior art and thereby providing unprecedented efficiency, durability, and economy in this type of apparatus and method, and especially permitting complete control of tolerances in the seal, use of much closer tolerances in the seal, and the maintenance of such tolerances during long periods of operation, said seal moreover being effectively self purging.

OBJECTS OF THE INVENTION

It is an object of the present invention to provide improved apparatus and method of the class described. A further object is to provide improved sealing means for use in apparatus and method of the class described. A still further object is to provide apparatus and method of the class described which avoids the disadvantages and shortcomings of prior art apparatus and method and obtains numerous advantages thereover, including all those previously and hereinafter identified, as well as the elimination of "fines" from the seal area, thereby preventing and/or eliminating fouling of the seal by means of such fines, alternative exit means and path for the fines out of the finishing chamber and apparatus being provided. Still an additional object of the invention is to provide novel means and method for maintaining a hydrostatic head or pressure of water, liquid finishing compound, or other fluid in apparatus of the type described, and especially in the critical sealing area thereof, which not only provides efficient fluid lubrication of the seal and eliminates the presence of fines in the sealing area, but also effectively cushions and centers a rotating bottom or "spinner" on its essentially vertical central axis and in relatively-uniform spaced relationship to the outer upstanding wall of the finishing chamber when such is the structure employed. Additional objects and advantages will be apparent to one skilled in the art and still others will become apparent hereinafter.

BRIEF DESCRIPTION OF THE INVENTION

The objects of the present invention are attained by the provision of apparatus and method for surface finishing of parts or workpieces which comprises such an improved seal, including a resilient lip or other partial bottom-forming element on the rotatable bottom member or outer wall member, which forms, together with the cooperating and complementary apposed surface of the other member, a resiliently-restricted zone around the circumference of the rotary member and below the finishing chamber cavity throughout the surrounding sealing area, which can be continuously bathed and lubricated with liquid vehicle flowing upwardly therethrough under pressure, e.g., from a storage chamber below the finishing chamber bottom, and preferably also flowing directly into said seal under pressure from a second source outside of but adjacent to the finishing chamber wall, thereby permitting unprecedented closer tolerances, control and maintenance of same, automatic cushioning and self-centering of the rotatable bottom member when present, and continuous and efficient self-purging of the seal itself, and the method of effecting such steps and highly desirable results, all of which will be more fully disclosed hereinafter.

SUMMARY OF THE INVENTION

The invention then, in summary, comprises the following, inter alia:

Apparatus for finishing parts or workpieces by attrition with loose, comminuted, granular, or particulate solid finishing material in the presence of a liquid vehicle, which includes:

a finishing chamber having an internal cavity and containing surfaces comprising an outer upstanding wall member and a bottom member, said upstanding wall member and said bottom member being symmetrically arranged about a common axis and being relatively rotatable about said axis in order to impart motion to the contents of said chamber for finishing of said parts or workpieces therein, and means for causing such relative motion, said outer wall member and said bottom member having closely-spaced apposed surfaces with seal means therebetween, characterized in that said seal means comprises a resiliently-restricted zone around the periphery of said bottom member and below said finishing chamber internal cavity, and means for providing fluid into said resiliently-restricted zone and for maintaining said fluid under a sufficient pressure to cause said fluid to enter into said resiliently-restricted zone and thence upwardly into said finishing chamber internal cavity; such apparatus wherein said resiliently-restricted zone is defined by a resilient lip or partial bottom-forming element on one member and a complementary surface on said other member cooperating with said lip to define the same; such apparatus wherein said bottom member is rotatable with respect to said wall member and said bottom member comprises said lip or partial bottom-forming element; such apparatus wherein said lip itself is outwardly-extended so as to provide a partial bottom for said resiliently-restricted zone; such apparatus wherein said means for providing and maintaining said fluid has the capacity to provide and maintain said fluid under a sufficient pressure and to cause said fluid to enter into said resiliently-restricted zone and thence upwardly into said finishing chamber cavity both when said apparatus is in operation and when said apparatus is idle; such apparatus wherein said means for providing and maintaining fluid under pressure is so located with respect to said resiliently-restricted zone as to cause said fluid to enter into said resiliently-restricted zone and thence into said finishing chamber from below; such apparatus wherein said means includes a fluid-storage chamber beneath said bottom member; such apparatus wherein said means for providing and maintaining fluid under pressure is associated with said storage chamber for causing said fluid to enter into said chamber cavity from below; such apparatus wherein said fluid-storage chamber is located beneath said bottom member about the periphery thereof; such apparatus wherein said lip or partial bottom-forming element is of resilient material and the apposed surfaces of said bottom member and said wall member in the area of said seal means are comprised of elastomeric material; such apparatus wherein said bottom member is an annular or circular member adapted to rotate with respect to a stationary outer upstanding wall member; such apparatus wherein said bottom member is mounted on a rotatable central column and rotatable therewith; such apparatus wherein said central column is hollow and wherein passageways are provided adjacent the bottom of said finishing chamber cavity and communicate with said hollow central column for drainage of fluid from said finishing chamber cavity; such apparatus including separate drainage means for drainage of fluid from the bottom of said finishing chamber cavity to obviate drainage through said seal means; such apparatus wherein said drainage means comprises a hollow central shaft and passageways thereinto; such apparatus wherein said bottom member is associated with a central column and said central column comprises a hollow shaft for drainage of fluid from said finishing chamber; such apparatus wherein said drainage means comprises a hollow rotatable central column and associated passageways thereinto from said finishing chamber for emptying of fluid from said finishing chamber; such apparatus wherein said means comprises a fluid-storage chamber located external of said finishing chamber; such apparatus wherein said means comprises a fluid-storage chamber outside of and adjacent to said finishing chamber upstanding wall member and associated passageways therethrough to provide fluid into said resiliently-restricted zone from the side; such apparatus wherein said fluid-storage chamber is located about the periphery of said outer upstanding wall; such apparatus comprising a fluid-storage chamber beneath said bottom member and a fluid-storage chamber located outside of and adjacent to said outer upstanding wall member; such apparatus wherein said fluid-storage chamber beneath said bottom member is located about the periphery of a rotatable bottom member and wherein another fluid-storage chamber is located about the periphery of said outer upstanding wall member.

apparatus wherein one end of said storage chamber is adjacent said central column and including secondary seal means for sealing said fluid-storage chamber against leakage at the end thereof adjacent said central column; such apparatus wherein said seal means includes a skirt and includes means for vertical adjustment to enable said seal means to be snubbed downwardly as the skirt thereof is subjected to wear; such apparatus wherein said fluid-storage chamber has a stationary bottom and comprises seal means between said central column and said stationary bottom of said fluid-storage chamber; such apparatus including separate drainage means for said storage chamber; such apparatus comprising also secondary drainage means for drainage of fluid above a predetermined level from said finishing chamber cavity; such apparatus comprising also secondary drainage means for drainage of fluid above a predetermined level from said finishing chamber cavity; and such apparatus comprising fluid level- and/or concentration-sensing means and asociated conduitry for altering the rate of fluid flow into the finishing chamber when a predetermined fluid level or concentration is attained within the finishing chamber cavity.

Moreover, an improved method for finishing parts or workpieces by a process which comprises subjecting said parts or workpieces to attrition by relative motion with loose, comminuted, granular, or particulate solid finishing material in the presence of a liquid vehicle in a finishing chamber, having an internal cavity and containing surfaces comprising an outer upstanding wall member and a bottom member which are relatively rotatable with respect to each other, with seal means therebetween, characterized by providing said seal means in the form of a zone around the periphery of said bottom member and below said finishing chamber cavity and introducing fluid under pressure into said zone and thence upwardly into said finishing chamber, providing separate means for drainage of fluid from said finishing chamber cavity, and effecting drainage of fluid from said cavity otherwise than through said seal means; such method wherein said fluid pressure is sufficient to cause said fluid to enter into said zone and thence upwardly into said finishing chamber when said apparatus is in operation or when said apparatus is idle; such method wherein said zone is a resiliently-restricted zone and including the step of providing a lip or partial bottom-forming element on one of said members as a partial bottom to said resiliently-restricted zone; such method wherein fluid is introduced continuously throughout a finishing operation; such method wherein said bottom member is rotatable with respect to said wall member and wherein said bottom member is provided with said lip or partial bottom-forming element, and whereby said bottom member is cushioned and centered about its vertical axis of rotation; such method including the step of causing said fluid to enter said resiliently-restricted zone from below; such method including the step of providing said lip or partial bottom-forming element of resilient material and providing apposed surfaces of said bottom member and said wall member in the area of said seal means of elastomeric material; such method including the step of providing said bottom member in the form of an annular or circular member adapted to rotate with respect to a stationary outer upstanding wall member; such method including the step of mounting said bottom member on a hollow rotatable central column which is rotatable therewith; such method including the step of providing passageways adjacent the bottom of said finishing chamber cavity and communicating with said hollow central column and draining fluid from said finishing chamber cavity through said passageways and column; such method wherein said bottom member is associated with a central column comprising a hollow shaft and including the step of draining fluid from said finishing chamber through said hollow shaft; such method including the step of causing said fluid to enter said resiliently-restricted zone from the side; such method including the step of causing said fluid to enter said resiliently-restricted zone both from the side and from below; such method including the step of providing fluid storage chambers beneath said bottom member and outside of and adjacent to said outer upstanding wall member and supplying said fluid under pressure from said chambers; such method comprising the step of sensing fluid level- and/or concentration in the finishing chamber and altering the rate of fluid flow into the finishing chamber when a predetermined fluid level and/or concentration is attained within the finishing chamber cavity; and finally such method comprising the step of providing secondary drainage means and draining fluid above a predetermined level from said finishing chamber cavity, as well as a method of cushioning and centering a rotatable bottom member of such apparatus about its essentially vertical axis by providing a seal comprising a zone around the periphery thereof and forcing fluid under pressure into said zone and upwardly into the finishing chamber cavity; and thereafter continuing to supply fluid under pressure throughout the finishing operation; and thereafter removing said fluid by internal drainage and otherwise than through said seal.

BRIEF DESCRIPTION OF THE DRAWINGS

The invention will now be described with particular reference to the drawings, in which.

DETAILED DESCRIPTION OF THE INVENTION

Figure 1:
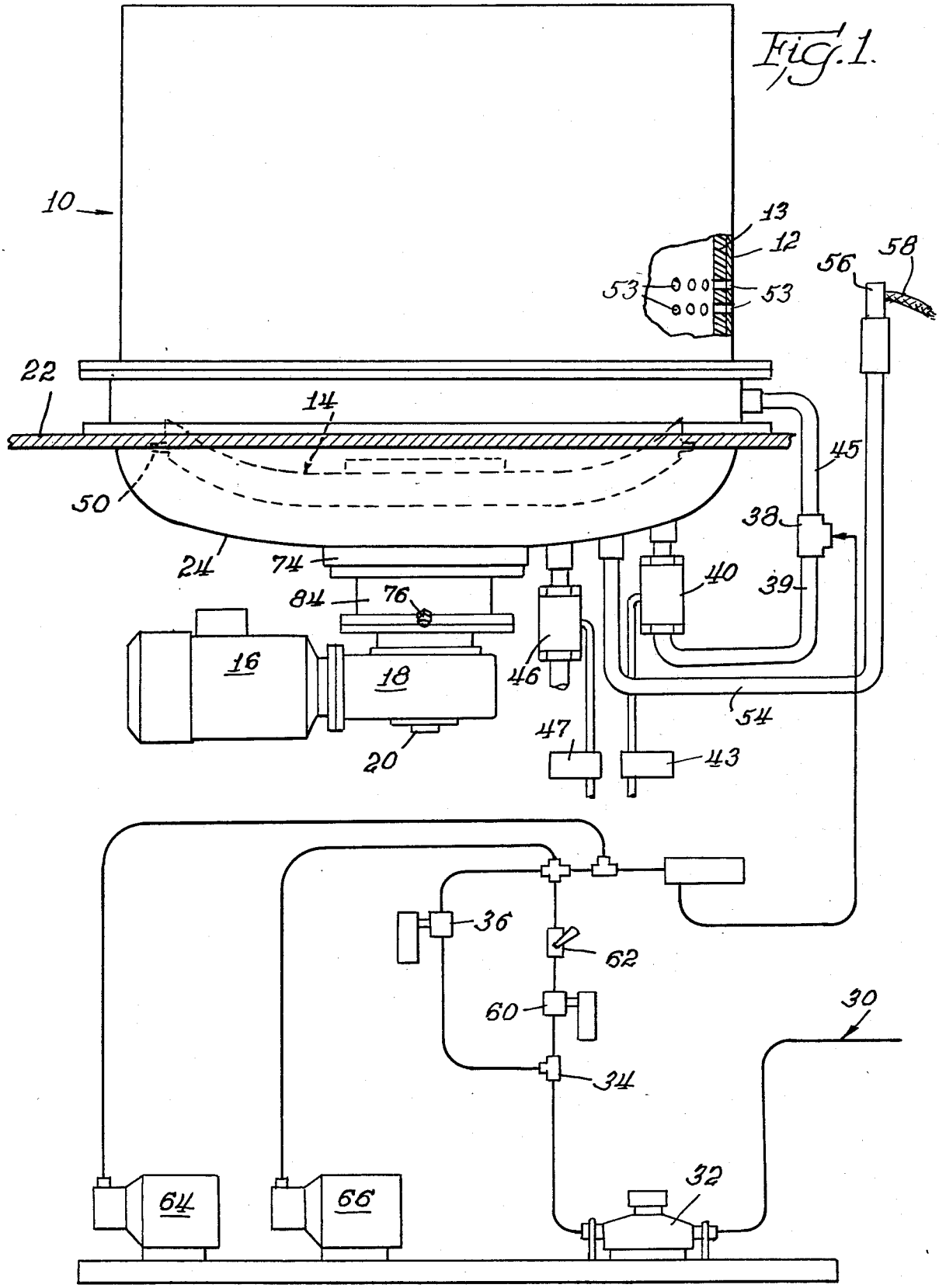
FIG. 1, is a schematic elevational view of the finishing chamber or "tub" portion of a centrifugal finishing apparatus according to the present invention together with associated centrifugal drive mechanism, conduitry and control system.
Figure 2:
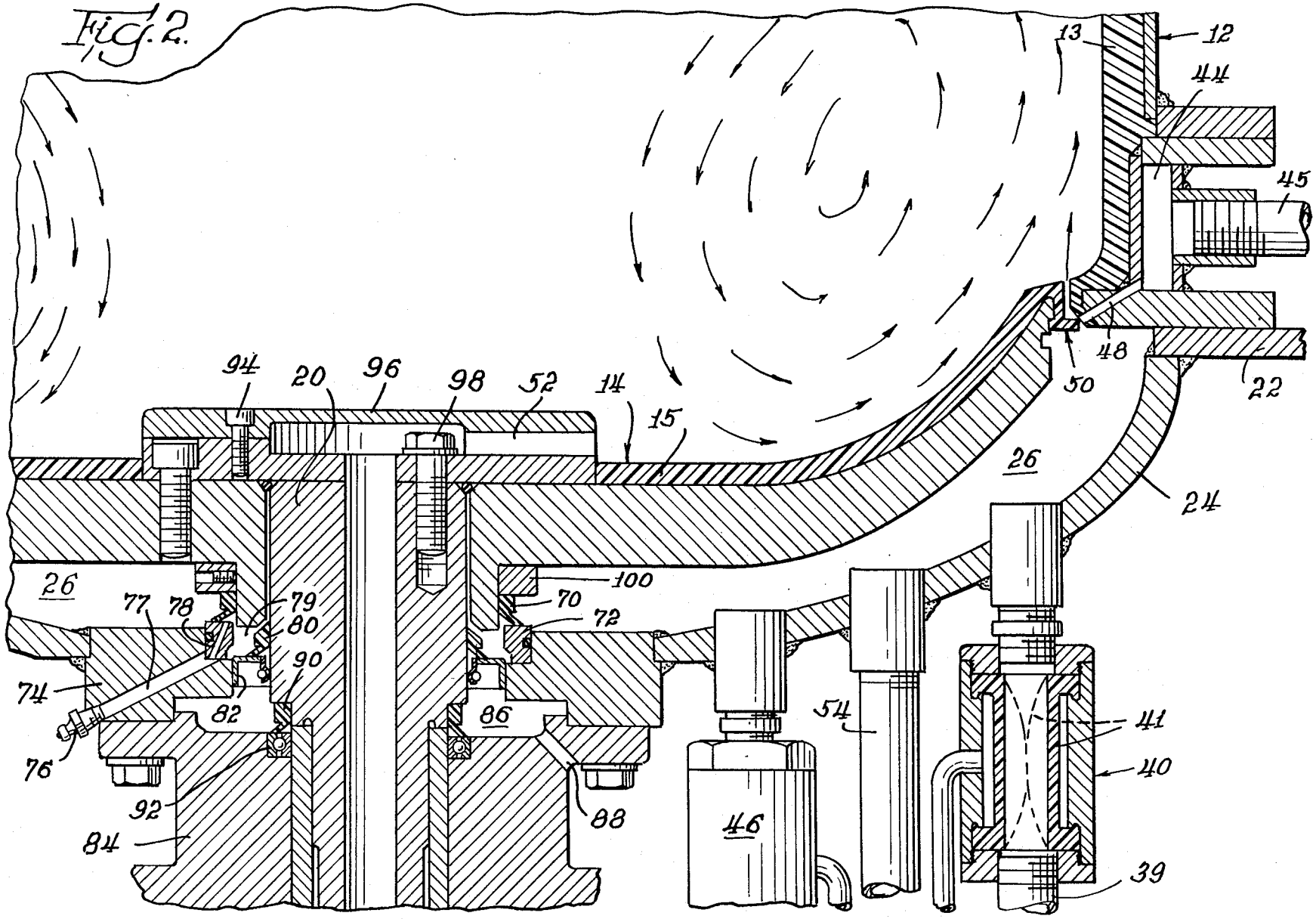
FIG. 2 is a detailed sectional view of the lower portion of the finishing chamber or "tub" shown in FIG 1, more specifically illustrating the unique seal of the present invention and the structure providing the same and the method of operation of such device according to the invention.

Referring now to FIGS. 1 and 2, there is illustrated a form of the invention which comprises an annular-or circular-shaped finishing chamber 10 having containing surfaces comprising a rotatable bottom member 14 and an outer stationary wall member or shell 12.

Outer stationary wall member or shell 12 has an elastomeric lining 13 and rotatable bottom member 14 has an elastomeric lining 15. Rotatable bottom member or "spinner" 14 is driven about its essentially vertical axis, which is shared in common with surrounding wall member 12, by a motor 16 through gearhead 18 and hollow shaft 20, which hollow shaft in the embodiment shown is also utilized to assist with drainage of the system as will be hereinafter described. The rotatable bottom member 14 is preferably of an arcuate cross-section, as shown, but in some embodiments may be flat or nearly flat, with only some loss in efficiency which may be tolerated in certain operations.

This finishing chamber portion of the finishing machine is supported by a shelflike portion or plate 22 of a standard frame (not shown), which is adapted either for stationary mounting of this portion of the device or for resilient mounting of this portion of the device, depending upon whether or not vibrations are desired or required and depending upon whether or not an auxilliary vibratory motor or means is employed to impart or increase the vibrations, all as is well known and understood in the art. Likewise, according to the skill of the art, the mounting may include hinged or breakaway portions for tilting of the device to assist with emptying of the finishing chamber, or other emptying means may be employed, again as well known in the art but as will be described further hereinafter.

Between rotatable bottom member 14 and stationary bottom portion 24 of the finishing chamber is provided a bottom storage chamber 26, which is filled with fluid or liquid vehicle such as water, cleaning fluid, or finishing compound maintained under pressure by pumping of said fluid into bottom storage chamber 26 around the periphery of bottom member 14 and thence upwardly into the finishing chamber internal cavity. This has the further desirable effect of centering and cushioning rotatable bottom member 14, which as shown is provided with the important bottom-forming resilient lip 50 of the restrictor-type seal around the circumference thereof, thereby to provide a resiliently-restricted zone around the periphery of bottom member 14 and below the internal cavity of the finishing chamber.

The source of fluid pumped into chamber 26 is shown schematically in FIG. 1 with water entering via inlet 30, passing through flowmeter 32, thence through tee connection 34, through solenoid valve 36, and thereafter through suitable pipe fittings into tee connection 38 located at one side of the tub or chamber 10. From tee fitting 38 the fluid is fed through pipe 39 to pneumatically operated valve 40 connected to the bottom of chamber 26 through wall 24 and controlled by two-way solenoid valve 43. Pneumatic valve 40 has a tubular elastomeric actuating element 41. With valve 40 open, the chamber 26 is rapidly filled. A second annular chamber 44 around wall 12 and which may actually be considered an exterior portion thereof is also filled with fluid via tee connection 38 and connecting pipe 45. In FIG. 2 valve 40 is shown in open position and in dotted lines in closed position.

A similar pneumatic valve 46 is normally closed and controls the drainage of chamber 26. Valve 46 is operated by air valve 47. A series of inwardly-directed passageways 48, which may be sixteen (16) in number, located about the reach of annular chamber 44, communicate chamber 44 with restrictor-type seal comprising resilient lip 50, thus lubricating the same with fluid, especially during operation. Restrictor-type seal comprising resilient lip 50 and cooperating and complementary apposed section of wall 12 elastomeric lining 13 provide sufficient clearance and define a resiliently-restricted zone at the sealing area, into which fluid vehicle is forced upwardly from chamber 26 by the fluid pressure from below. In a less preferred embodiment, resilient lip 50 may be provided upon the lower portion of the outer upstanding wall member 12 and may be a continuation or extension of its elastomeric lining 13, or lips may be present on both bottom and wall members, but in any case lip 50 provides a partial bottom to the resiliently-restricted zone formed around the periphery of bottom member 12 and below the finishing chamber internal cavity. Alternatively, if desired, such partial bottom and such resiliently-restricted zone may be provided in the form of partial bottom- or lip-forming faces in one or both of the elastomeric linings 13 and 15 in the seal area, such as apposed concave surfaces, or apposed V-shaped surfaces (with the open legs of the Vs facing each other), or any combination of apposed surfaces so arranged as to provide a partial bottom to the restrictor-type seal and in any event so as to provide such a resiliently-restricted zone, preferably comprising such a partial bottom- or lip-forming element so arranged as to prevent entry of contaminants into said seal while directing fluid flow upwardly through said zone and sealing area into the finishing chamber cavity.

Simultaneously, once chamber 44 is filled with fluid vehicle, fluid vehicle is forced directly into the resiliently-restricted zone around bottom member 14 via passageways 48 located around outer wall 12 under a hydrostatic head or fluid pressure maintained sufficient for this purpose, thus providing a further supply of liquid vehicle from a second source outside of the finishing chamber itself.

A certain and predeterminable amount of fluid under pressure passes from chamber 26 up through the seal around lip 50 into the interior of the finishing chamber, where it mixes with finishing media and workpieces or parts being finished. The fluid pressure or hydrostatic head in chamber 26 is maintained sufficient to effect this upward fluid flow. By this upward passage into the finishing chamber, the fluid prevents the fines produced by the finishing operation from depositing in or upon the seal and especially upon lip 50, which greatly prolongs the life of the seal during operation. This upward flow and the path of the media and workpieces in the finishing chamber is shown by arrows in FIG. 2, the rolling motion of the mass of media and workpieces being a result of the centrifugal force provided by rotation of the rotatable bottom member or "spinner" 14 whereby the mass of parts and workpieces is caused to impinge against the outer stationary wall member or shell 12.

When rotation of the rotatable bottom member 14 is terminated, the finishing media and workpieces are no longer forced outwardly by centrifugal force and will level off in the finishing chamber. For use at this point in the operation, to assist with drainage of fluids from the finishing chamber, a series of passageways 52, illustratively six in number, are provided centrally, which allow the fluid to pass from the bottom of the finishing chamber cavity into hollow drive shaft 20 and out the bottom thereof to a drain or collection means (not shown), whereafter the parts or workpieces may be removed from the tub in any convenient and/or conventional manner.

A third pipe 54 communicates with a level and/or concentration sensor 56 with associated circuitry 58 connected to appropriate indicators or dials (not shown) for readout by the operator as to the fluid level and/or concentration in the finishing chamber cavity at any particular moment.

When chambers 26 and 44 are filled with fluid, which can be accomplished efficiently at a high rate of flow, valve 36 is closed and valve 60 opened so that the fluid then passes through manual flow-control valve 62 which can be set or preset for continued flow of fluid at a relatively low flow rate through low-flow flowmeter 63 and through the associated conduitry into chambers 26 and 44, which flow rate is of course adjustable according to the desires of the operator.

Pumps 64 and 66 or both may be actuated by the operator as desired, each for providing liquid finishing compound into the fluid stream from sources not shown as desired by the operator for any particular finishing operation. If desired, one of said pumps may provide a different type of compound, e.g., for maintaining lubricity, upon termination of a particular finishing cycle or upon shutdown of the apparatus.

For maintaining the pressure in chamber 26, a series of seals and seal-bearing rings is provided. The first seal 70 comprises a tight-fitting ring-type body having a cone-shaped skirt which bears against a seal ring 72, which in turn is tightly fitted into the stationary bearing portion 74 of stationary bottom portion 24, said ring 72 having a series of passageways 78 to accomodate lube grease and to allow any fluid which escapes seal 70 and into the seal cavity 79 to drain out via passageways 78.

A second seal 80, somewhat similar to to seal 70, has its skirt bearing on a formed metal-type ring 82. Between this seal ring 82 and the main bearing holding casting 84 is provided a cavity 86, for purposes of visually observing whether or not there is excessive leakage and for inspection of seals, inspection passageways 88 being drilled through the upper flange of casting 84. To accomodate lube grease and/or heavy oils for lubrication of seals 70 and 80, grease fittings 76 are provided and threaded into the lower ends of passageways 77 communicating with through-holes drilled in seal ring 72 into annular cavity 79 and with passageways 78.

A bottom seal 90 has its skirt riding on the stationary part of bearing 92, mounted in casting 84.

By removing cap screws 94, the hub cover 96 can be removed to expose bolts 98, which can in turn be removed for lifting of rotatable bottom member 14 out of the chamber for ready relining thereof with elastomer 15 and, when necessary, replacement of resilient lip 50. Outer stationary wall member or shell lining 13 may also be conveniently replaced with this portion of the device removed, and it will be apparent that seal 70 may be relocated downwardly by lowering collar 100 by means of set screws locking said collar in place. Accordingly, seal 70 can be snubbed downwardly when necessary or desirable to take up on wear as it appears on the skirt of seal 70.

One obvious advantage of feeding fluid through the seal and around resilient lip 50 or other partial bottom-forming element into the resiliently-restricted zone and thence upwardly into the finishing chamber cavity is that any given finishing operation can if desired commence with a relatively large and dry type of abrasive media which would ordinarily be employed to remove the rougher edges or burrs from workpieces or parts with gradual introduction of more liquid as the media commences to wear down into finer particulate form, thus becoming more of a polishing media, so that the basic structure, apparatus and method of the present invention enable the operator to perform two or three operations, without stopping the machine, which would otherwise be impossible. In addition, and foremost, is the advantage that the upward motion of the fluid from chamber 26 and passageways 48 through, around, and about the seal and resilient lip 50 or other partial bottom-forming element into the resiliently-restricted zone and thence into the interior of the finishing chamber eliminates fouling of the seal and lip 50 by fines or other particulate material, especially as drainage from the finishing chamber, even for emptying of the same, is not through the seal and around lip 50 but is in contrast through internal central passageways 52 and thence through the open center of hollow shaft 20 to the outside of the machine.

It will be apparent to one skilled in the art that some mounting frames are equipped with pillow-block bearings which receive trunnions which are in turn fastened to the sides of the finishing chamber or tub, as by means of shelf 22, the same being well-known in the art and not shown, it being understood that in such type of finishing machine mounting there would also be provided flexible connections between the stationary parts and the tiltable tub. Such tilting mechanisms are often provided to facilitate easier loading and unloading of the charge.

To assist in the draining of a tiltable tub, a series of openings 53 may be provided. These are drilled through the side wall of the outer stationary portion or shell 12 of the finishing chamber 10 at such a height that fluid can conveniently arc away while the rotatable portion 14 of the finishing chamber is still spinning. In such an operation, it is of course to be understood that these drainage openings 53 are provided in a position so as to be relatively downwardly disposed when the finishing chamber is tilted for unloading, thus to allow the fluid therein to drain out. In addition, such openings 53 or similar openings may be associated with pipe connections to a drain or collection means (not shown) to prevent overflow or to maintain a maximum level of fluid in the finishing chamber, in which case they will cooperate with central passageways 52 for control of liquid level in the finishing chamber.

In the foregoing manner and by employing the foregoing apparatus, an excellent sealing system is provided, together with a central drainage exit passageway which does not involve the seal, as well as a suitable drainage mechanism for any leakage, excess, or overflow which might occur, thus ensuring long life for the sealing system.

In the operation of the device of FIGS. 1 and 2, the parts or workpieces, the relatively large finishing material, media, or chips, and liquid vehicle to the extent desired, along with any fine finishing material which may be desired, are charged into the annular finishing chamber 10 through the open top thereof. A hydrostatic or fluid pressure head is provided at all or essentially all points around the circumference of the rotatable bottom member 14 due to the fluid under pressure which is forced around lip 50 when present and into the resiliently-restricted zone of the sealing area from chambers 26 and 44 and into the passageways 48 spaced around said circumference, thereby providing a fluid cushion for rotatable bottom member 14, centering same on its vertical axis in uniformly spaced relation to upstanding sidewall 12, moreover sweeping upwardly into the finishing chamber cavity and eliminating any solid contamination of the seal and allowing immediate startup of the finishing operation, without introduction of any liquid vehicle from the top, if so desired. Rotation of the rotatable bottom member 14 causes the contents of chamber 10 to be impelled radially outwardly by centrifugal force generated by said rotation. The mass of finishing medium, parts or workpieces, and liquid medium therein sweeps up across the upward slope of the dish-shaped bottom 14 and impinges on the lining 13 of the outer upstanding wall member 12. As rotation continues, a fluid pressure head builds up alongside the upstanding wall member 12 and at its junction with rotatable bottom member 14 and in the area of the seal and around lip 50, when present, i.e., in the outer edge or rim areas of the rotatable finishing chamber bottom member 14, and would ordinarily be forced by said fluid pressure head downwardly into said seal. However, according to the present method of operation and using the apparatus of the invention, the hydrostatic head or fluid pressure in chamber 26 prevails and, instead of fluid plus fines entering downwardly into the seal area, the fluid under pressure from chamber 26, due to its upward movement into the finishing chamber cavity, keeps lip 50 when present or other partial bottom-forming element and the resiliently-restricted zone in the sealing area continuously lubricated and fine free, the lip functioning both to direct the fluid flow upwardly into the finishing chamber cavity and to prevent contaminants from entering the resiliently-restricted zone, especially from below. Thus, relative motion is imparted to the contents of the chamber, including the liquid vehicle, to cause finishing of the parts, and said contents are caused to flow outwardly across a containing surface, a portion of which moves relative to another portion thereof, in such a manner that the liquid vehicle, including any "fines" entrained therein, is still caused to flow outwardly, but is no longer permitted to flow between these relatively closely-positioned relatively-rotating portions of the apparatus. This fluid pressure and the upward flow generated thereby is equally operative when the apparatus is operating at maximum speed of rotation and when it is at rest, and at all modes in between, and is preferably caused to operate continuously starting before a finishing run and ending thereafter, to keep the seal at all times free of fines and other contamination.

Liquid vehicle, as is conventional in the finishing art, may also be introduced into the finishing operation through the open top of the finishing chamber, although this is no longer necessary due to its ready availability from chambers 26 and 44 and through the resiliently-restricted zone of the seal and lip 50, which essentially comprises a partial bottom for said zone, or other partial bottom-forming element, upwardly into the finishing chamber cavity. The liquid vehicle as usual serves to cool the reaction mass, and to carry off or entrain "fines", thereby removing them from the area of the major finishing operation through the internal drainage system provided therefor by the present invention (and not through the seal), and the liquid may be or comprise water, aqueous detergent or soap solution, solutions of chemical cleansing or brightening agents, or the like, all as conventional in the art. Such liquid vehicle may as usual be introduced at a metered flow-rate through ancillary equipment such as storage container, pump, and associated pipes, hoses, or tubing, none of which, except as claimed, is of the essence of the present invention. The liquid vehicle may simply be dumped into the open top of the finishing material from a bucket or other container, if this is satisfactory for the particular finishing operation involved. Ordinarily the source of the liquid vehicle for intermittent or continuous introduction into the finishing operation and chamber is through spray headers or perforated pipe or tubing or the like, located either internally of the finishing chamber or externally thereof, and most conveniently through such pipe or tubing peripherally located at or near the upper edge of an upstanding wall of the finishing chamber, preferably at or about the inner lip of the outer upstanding wall of the finishing chamber. All of this equipment and ancillary equipment for introduction of the liquid vehicle intermittently or continuously into the finishing operation and finishing chamber is standard and conventional in the art as it exists today and is accordingly not shown in the drawings, and it is all in actuality rendered essentially unnecessary and obsolete when operating according to the apparatus, structure, and method of the present invention.

VIBRATORY ASPECT

As described in U.S. Pat. No. 3,435,565, when only means for rapid rotation of the medium and parts about a substantially vertical axis are employed, the mass or content of the finishing chamber assumes an outward and upward plus inward and downward motion, thereby producing a toroidal flow with individual parts and particles of the medium travelling helically around the toroid. When means, not shown but well-known in the art, for imparting vibratory or gyratory motion to the contents of a finishing chamber having a rotatable bottom or spinner, preferably but not necessarily a curvilinear or arcuate-bottom (as here shown; see FIGS. 1 and 2) are also present, the parts or workpieces and/or finishing material contained therein undergo the further or accelerated motion which may be described as toroidal precession, i.e., the contents move upwardly at the peripheral portion of the chamber and downwardly at the inner portion of the chamber, while simultaneously describing precessional motion (linear progression) around the chamber in the direction of rotation of the bottom. Such motion results in further relative movement between the finishing material and the workpieces, or at least further interaction therebetween, causing the parts to be further and sometimes more efficiently finished, and moreover can be used to assist in separation of finished parts by co-operation of such precessional motion with internal separating means, especially since the rate of precession can be readily controlled by control of the gyratory motion imparted to the finishing chamber, all as well known in the art and as fully described and claimed in U.S. Pat. Nos. 3,990,188 and 4,026,075.

PARTS RETRIEVAL

Alternative forms of part retrieval apparatus may be utilized if desired, especially in vibrational or gyrational type apparatus. One form of apparatus is disclosed in U.S. Pat. No. 3,514,907 comprising a hingedly-mounted gate in the side wall of the finishing chamber which may be opened and closed by means of a hydraulic cylinder. When the gate is opened, a retrieval apparatus comprising a ramp, screen, and discharge chute may be inserted into the recess resulting from opening the gate, and parts separated from the finishing material are discharged thereby. Alternatively, a so-called "chip pump" may be lowered into the finishing chamber and, as disclosed in U.S. Pat. No. 3,400,495, the parts separated and retrieved as taught in the disclosure of said patent.

LININGS

Advantageously, the finishing chamber is lined with a soft resilient material to protect the parts or workpieces being finished. Ordinarily this is made of urethane or other elastomer. A coating of this elastomer, e.g., polyurethane, is bonded to the upstanding wall member and another coating is bonded to the upper or chamber-forming surface of the rotatable bottom member. The linings can be shaped to themselves provide mutually-apposed surfaces in the sealing area, as shown in the drawings or, advantageously, these linings can have removable and replaceable insets providing the apposed faces and/or lip required or desired for the sealing means and in the sealing area. The removable insets can be provided with means for affixing them, respectively, to the lower part of the rigid upstanding wall member and/or to the upper and outer peripheral surface of the outer rigid part of the rotatable bottom member, or both. Such insets are generally unnecessary with the structure and method of the invention.

The apposed faces of the sealing means, advantageously, have a size or thickness which, at the shortest distance from inside the chamber to the exterior, is at least several times the width of the space between the faces. In usual prior art structures, this gap is usually on the order of 0.02 inch but, due to the efficiency of the structure and method of the present invention, may now be as small or narrow as 0.004 inch. This is possible because the upwardly-flowing fluid vehicle, which is generally water, aqueous detergent solution, or the like, cools and lubricates and cleans the sealing surfaces during its travel to the interior or the finishing chamber from chambers 26 and 44 via the resiliently-restricted zone and as directed by resilient lip 50 when present.

MEDIA

"Finishing chips", "finishing particles", and "finishing medium", "media", or "materials" are all terms of art having their usual meanings. When the terms "finishing materials" or "finishing media" are used herein, they are intended to define loose, comminuted, granular, or particulate, and in any event, solid finishing materials of the type which are presently employed in the trade and any others of a similar nature. Such materials or media include discrete "particles" called "chips" in the trade. Such "chips" or "particles" are usually "relatively large", such reference meaning relative to the magnitude of the opening of the seal at the juncture of the relatively-moving surface portions of the seal. Such description indicates impenetrability of the opening between the sealing surfaces by the intact or nearly intact particles or "chips" comprising the finishing medium which, accordingly, are not a major cause of fouling of the seal, whereas the "fines" produced by attrition during the finishing process have historically been a major factor in fouling and deterioration of the seal.

THE FINISHING CHAMBER

Although the finishing chamber outer upstanding wall member has sometimes been described herein as being circular, annular, or essentially annular, it is to be understood that this is in a usual top plan view and that it is not essential that such a defining wall of the finishing chamber be annular or circular in any precise sense of the term. It is only necessary, when the bottom member of the finishing chamber is annular or circular, and especially when it is the rotatable member, that the outer upstanding wall be insufficiently cornered so as to prevent the free flow of finishing media in and around the interior of the particular section of the finishing chamber involved. For example, the top plan view of the finishing chamber may be only generally circular including decagonal, octagonal, hexagonal, or pentagonal, or may have any other somewhat cornered cross-section which does not detract from a general annular or circular nature and which, in particular, does not interfere with the flow of media within the interior of the finishing chamber. Although a truly annular or circular cross-section is preferred, other generally annular and generally circular cross sections may be imparted to the finishing chamber outer wall member with equal or only somewhat reduced efficiency, as will be apparent to one skilled in the art.

THE ELASTOMER

Any suitable and usual elastomer can be employed in producing the resilient sealing lip 50, and the apposed seal surfaces, and the elastomeric chamber lining which is required according to certain embodiments of the invention and preferred for completion of the finishing chamber. The term "elastomeric lining" as used herein is to be understood to be a lining formed of any numerous natural or synthetic elastomers which stretch under tension, have a high tensile strength, retract rapidly, and essentially recover their original dimensions. Examples include natural rubber, homopolymers such as polychlorobutadiene, polybutadiene, polyisoprene, copolymers such as styrene-butadiene rubber, butyl rubber, nitrile rubber, ethylene-propylene copolymers, fluorine elastomers, and polyacrylates, polycondensation products such as polyurethanes, neoprene, ABS rubber, PVC rubber, silicone rubber, and polysulfide rubber, as well as chemical conversions of high polymers such as halogen-substituted rubbers. Shore A hardness between fifty (50) and (100), preferably about sixty-five (65) to ninety (90), is usually preferred, at least for the lining. When the elastomer is of the polyurethane type, it may be prepared by the prepolymer method or by mixing the ingredients concurrently or simultaneously through several nozzles in a so-called "one-shot" application involving the instantaneous reaction of two or three components. Other details of elastomeric lining and its formation according to conventional practice of the art may be found in columns 9 and 10 of U.S. Pat. No. 4,480,411.

The elastomeric lining may advantageously be employed in a pourable form which upon setting, in the presence of a mold, results in any desired configuration of chamber lining which may be advantageous or desirable. The ADIPRENE (TM) family of urethane elastomers produced by DuPont, and CONATHANE (TM) two-component polyurethane casting systems, produced by Conap, Inc., Olean, N.Y., are particularly suitable for use in accord with the present invention. The CONATHANE TU-79 (TM) system is particularly adaptable to the production of finishing chamber linings inasmuch as it attains a Shore A hardness of 80±5 and has excellent tensile strength and compression characteristics. Moreover, upon admixture of the two parts of the two-part system, the initial mixed viscosity at 25° C. or 77° F. is only 4,000 cps, thus making it pourable into almost any configuration for the production of chamber linings according to the invention, whether in forms to be subsequently bonded to the finishing chamber wall or to a release agent on said finishing chamber wall, or whether poured directly into the finishing chamber, thereby to become self-bonding to the wall or to a thermally-activatable release agent on the interior surface thereof upon curing. With a pot-life of 35 to 40 minutes at 25° C. and the ability to cure at room or elevated temperatures, this system has been found highly satisfactory. The cure of one hour at 25° C. plus 16 hours at 80° C. is convenient and, alternatively, the applied elastomer can be cured by allowing it to stand for seven (7) days or less at 25° C. If a mold is employed, as is usually the case and which is usually preferred in today's practice, mold releases of various types can if desired also be employed to obtain rapid, clean, and convenient release from the mold, as is now conventional in the art. The elastomeric lining is preferably bonded to the chamber wall or bottom or to a thermally-activatable release agent on the inside surface of the finishing chamber wall or bottom by pouring in place in fluid or semifluid condition and allowing to cure in place, with possible application of heat and use of curing agents if desired, or the lining may as previously mentioned less desirably be preformed and bonded to the interior surface of the finishing chamber wall or bottom or to a thermally-activatable release agent on the inside surface of the finishing chamber or bottom directly, with or without the application of external heat and/or further adhesive. The insertion of a unitary mold into the finishing chamber void and the pouring of the elastomer into the finishing chamber void around said mold and allowing it to cure is one preferred and usual embodiment, with appropriate modification in the procedure for separate lining of the relatively-rotatable bottom.

In conclusion, from the foregoing, it is apparent that the present invention provides a novel centrifugal finishing apparatus and method involving unique structural features as well as a novel means of providing a hydrostatic head or pressure of fluid within the apparatus and especially the continuous and upward flow of liquid vehicle in the sealing area and into the resiliently-restricted zone and around any sealing lip thereof in such a manner as to preclude fouling of the seal by "fines" or other undesirable solid contaminants, and that the apparatus and method as provided by the present invention have the foregoing enumerated characteristics and advantages, including but not limited to ease and rapidity of operation, essentially foolproof seal and hydrostatic head maintenance, immediate centering of a spinner or rotating bottom member about its central essentially vertical axis and in uniform spaced relationship at its outer periphery from the outer upstanding stationary wall member of the finishing chamber, and method and means for removing fines and other solid contaminants from the finishing chamber without any essential contact thereof with the seal or the sealing area between the circumference of the bottom member and the outer upwardly extending wall member of the finishing chamber.

A further advantage of the embodiment of the invention wherein cooling fluid is caused to enter the resiliently-restricted zone from the side, as is the case when there is a fluid-storage chamber outside of and adjacent to the finishing chamber upstanding wall member with associated passageways therethrough to provide fluid into said resiliently-restricted zone from the side, especially when said fluid-storage chamber and associated passageways are located about the periphery of the outer upstanding wall member, and especially when such cooling fluid is introduced throughout a finishing operation, is that the fluid can enter directly into the resiliently-restricted zone without any essential period of storage in a storage chamber, thereby permitting a lower temperature of the cooling fluid than if it were allowed to stand for extended periods before introduction into the resiliently-restricted zone, and thereby also increasing substantially the extent of cooling which can be effected within the finishing zone and in the resiliently-restricted zone, with the further attendant advantage of also reducing the expansion (and consequent wear) of the material of construction of the resiliently-restricted zone, especially since elastomeric materials of the type employed expand less at lower temperatures.

It is to be understood that the invention is not to be limited to the exact details of operation, or to the exact compositions, methods, procedures, or embodiments shown and described, as obvious modifications and equivalents will be apparent to one skilled in the art, and the invention is therefore to be limited only by the full scope which can be legally attributed to the appended claims.

I claim:

1. Apparatus for finishing parts or workpieces by attrition with loose, comminuted, granular, or particulate solid finishing material in the presence of a liquid vehicle, which includes:

a finishing chamber having an internal cavity and containing surfaces comprising an outer upstanding wall member and an imperforate bottom member, said upstanding wall member and said bottom member being symmetrically arranged bout a common axis and said bottom member being rotatable about said axis in order to impart motion to the contents of said chamber for finishing of said parts or workpieces therein, and means for causing such motion, said outer wall member and said bottom member having closely-spaced apposed surfaces with seal means therebetween, characterized in that said seal means comprises a resiliently-restricted zone around the periphery of said bottom member, said zone being defined by a resilient bottom-forming element on said bottom member and upwardly-extending side walls formed by complementary upwardly-extending surface on said bottom member and on said upstanding wall member, said resilient bottom-forming element extending outwardly beyond the upwardly-extending surface on said bottom wall, and;

means for providing fluid into said resiliently-restricted zone and for maintaining said fluid under a sufficient pressure to force said fluid to enter into said resiliently-restricted zone and thence upwardly into said finishing chamber internal cavity around the periphery of said bottom member and said bottom-forming element.

2. Apparatus of claim 1, wherein said means for providing fluid comprises a fluid-storage chamber outside of and adjacent to said finishing chamber upstanding wall member and associated passageways therethrough to provide fluid directly into said resiliently-restricted zone from the side.

3. Apparatus of claim 3, wherein said fluid-storage chamber is located bout the periphery of said outer upstanding wall member.

4. Apparatus of claim 2, comprising a fluid-storage chamber beneath said bottom member and a fluid-storage chamber located outside of and adjacent to said outer upstanding wall member and surrounding the some.

5. Apparatus of claim 1, wherein said means for providing and maintaining said fluid comprises fluid level sensing means and valve means and has the capacity to provide and maintain said fluid under a sufficient pressure and to cause said fluid to enter into said resiliently-restricted zone and thence upwardly into said finishing chamber cavity both when said apparatus is in operation and when said apparatus is idle.

6. Apparatus of claim 5, wherein said means for providing and maintaining fluid under pressure is so located with respect to said resiliently-restricted zone as to cause said fluid to enter into said resiliently-restricted zone and thence into said finishing chamber from below.

7. Apparatus of claim 5, wherein said means for providing and maintaining fluid under pressure includes a fluid-storage chamber beneath said bottom member.

8. Apparatus of claim 7, wherein said means for providing and maintaining fluid under pressure is associated with said storage chamber for causing said fluid to enter into said chamber cavity from below.

9. Apparatus of claim 7, wherein said fluid-storage chamber is located beneath said bottom member about the periphery thereof.

10. Apparatus of claim 10, comprising fluid level and/or concentration-sensing means and associated solenoid and pneumatic valve means and conduitry for altering the rate of fluid flow into the finishing chamber when a predetermined fluid level or concentration is attained within the finishing chamber cavity during a finishing operation.

11. Apparatus of claim 1, wherein said bottom-forming element is of resilient material and the apposed surfaces of said bottom member and said wall member in the area of said seal means are comprised of elastomeric material.

12. Apparatus of claim 1, wherein said bottom member is mounted on a rotatable central column and rotatable therewith, wherein said central column is hollow and wherein a passageway is provided adjacent the bottom of said finishing chamber cavity communicating with said hollow central column for drainage of fluid from said finishing chamber cavity.

13. Apparatus of claim 12, wherein one end of said storage chamber is adjacent said rotatable central column and including secondary seal means for sealing said fluid-storage chamber against leakage at the end thereof adjacent said rotatable central column, and wherein said seal means includes a skirt and includes means for vertical adjustment to enable said seal means to be snubbed downwardly as the skirt thereof is subjected to wear.

14. Apparatus of claim 1, including drainage means for drainage of fluid from the bottom of said finishing chamber cavity to obviate drainage through said seal means, wherein said drainage means comprises a hollow central shaft and a passageway thereinto located centrally adjacent the bottom of said finishing chamber cavity.

15. Apparatus of claim 1, wherein said bottom member is associated with a hollow rotatable central column on which said finishing chamber bottom member is mounted for rotation and a passageway thereinto from said finishing chamber located centrally adjacent the bottom thereof for emptying of fluid from said finishing chamber.

16. Apparatus for finishing parts of workpieces by attrition with loose, comminuted, granular, or particulate solid finishing material in the presence of a liquid vehicle, which includes:

a finishing chamber having an internal cavity and containing surfaces comprising an outer upstanding wall member and a bottom member, said upstanding wall member and said bottom member being symmetrically arranged about a common essentially vertical axis and said bottom member being rotatable about said axis in order to impart motion to the contents of said chamber for finishing of said parts of workpiece therein, and means for causing such relative motion, said outer wall member and said bottom member having closely-spaced apposed surfaces with seal means therebetween, said seal means comprising a zone around the periphery of said rotatable bottom member, said bottom member being mounted on a rotatable central column and rotatable therewith, said central column being hollow, and a passageway into said hollow column from said finishing chamber cavity for drainage of fluid from said finishing chamber cavity.

17. Apparatus of claim 16, wherein said seal means is restrictor-type seal means and said zone is a resiliently-restricted zone.

* * * * *

UNITED STATES PATENT AND TRADEMARK OFFICE

CERTIFICATE OF CORRECTION

PATENT NO. : 4,884,372

DATED : December 5, 1989

INVENTOR(S) : Gary L. McNeil

It is certified that error appears in the above-identified patent and that said Letters Patent is hereby corrected as shown below:

Col. 2, line 15; "fulfils" should read -- fulfills --
Col. 2, lines 19 & 20; "premitting" should read -- permitting --
Col. 5, line 10; "asociated" should read -- associated --
Col. 9, line 15; "accomodate" should read -- accommodate --
Col. 9, line 25; "accomodate" should read -- accommodate --
Col. 16, line 21; "bout" should read -- about --

Col. 16, line 35; "surface" should read -- surfaces --

Col. 16, line 39; "and;" should read -- and --

Col. 16, line 54; "bout" should read -- about --
Col. 16, line 56; after "comprising" insert -- both --

Col. 16, line 60; "some" should read -- same --
Col. 17, line 17; "claim 10" should read -- claim 5 --

Signed and Sealed this

Nineteenth Day of February, 1991

*Attest:*

HARRY F. MANBECK, JR.

*Attesting Officer*

*Commissioner of Patents and Trademarks*